US005712642A

United States Patent [19]

Hulderman

[11] Patent Number: 5,712,642

[45] Date of Patent: Jan. 27, 1998

[54] SPATIAL POWER COMBINER USING SUBHARMONIC BEAM POSITION CONTROL

[75] Inventor: Garry N. Hulderman, Riverside, Calif.

[73] Assignee: Hughes Missile Systems Company, Los Angeles, Calif.

[21] Appl. No.: 595,423

[22] Filed: Feb. 5, 1996

Related U.S. Application Data

[63] Continuation of Ser. No. 313,479, Sep. 27, 1994, abandoned.

[51] Int. Cl.[6] ..... H01Q 3/22

[52] U.S. Cl. ..... 342/372; 342/157; 342/174

[58] Field of Search ..... 342/372, 157, 342/173, 174

[56] References Cited

U.S. PATENT DOCUMENTS

| | | | |
|---|---|---|---|
| 4,146,890 | 3/1979 | Klensch | 343/8 |
| 4,200,871 | 4/1980 | Roeder et al. | 343/7.4 |
| 4,692,766 | 9/1987 | Rolfs | 342/200 |
| 5,172,123 | 12/1992 | Johnson | 342/200 |

*Primary Examiner*—Thomas H. Tarcza
*Assistant Examiner*—Dao L. Phan
*Attorney, Agent, or Firm*—Charles D. Brown; Wanda K. Denson-Low

[57] ABSTRACT

An array antenna (10) that can form and sweep a predicted radiation beam pattern in different directions by using a subharmonic frequency signal from each voltage controlled oscillator (VCO) (20) to control the array phasing. Each VCO (20) generates a radio frequency carrier signal that drives an antenna element (16). A subharmonic signal is generated from a portion of the signal from the VCO (20). The subharmonic signal is mixed with a constant frequency signal to produce an intermediate frequency (IF) signal. The frequency of the IF signal is compared to the frequency of a variable frequency signal in a phase locked loop (PLL) (40). Since the phase of a signal is dependent on its frequency, the variable frequency signal is generated to have a frequency corresponding to a certain phase. The PLL (40) generates an error signal as a function of the difference in frequencies between these two signals. In response to the error signal, the VCO (20) changes the frequency of the carrier output signal. This process is continued by PLL (40) until the frequency of the IF signal is equal to the frequency of the variable frequency signal. The VCO (20) is now generating a signal having a frequency corresponding to the certain phase. The combined resultant relative phase excitation of all the antenna elements generates a maximum field intensity in a predicted direction.

26 Claims, 3 Drawing Sheets

SPATIAL POWER COMBINER USING SUBHARMONIC BEAM POSITION CONTROL

This is a continuation application Ser. No. 08/313,479, filed Sep. 27, 1994, abandoned.

BACKGROUND OF THE INVENTION

1. Technical Field

The present invention relates to an array antenna and, more particularly, an array antenna that utilizes a portion of the output signal from each of the voltage controlled oscillators to control the array phasing.

2. Discussion

Individual antenna elements that are designed for transmitting high microwave carrier frequencies (3 GHz to 300 GHz) are commonly fabricated in a uniform grid on a semiconductor substrate forming an array antenna. The power radiated from each active antenna element spatially adds and cancels with the radiation from all the other antenna elements. The total summation of the constructive and destructive interference at each point in space forms a radiation pattern. By controlling the amplitude, phase, or frequency of the excitation of each element, a particular radiation pattern can be formed. Usually, the variables for exciting the elements are chosen in order to form a radiation pattern having a main beam which can be swept across particular directions. For example, RADAR systems select the relative phase of the excitation of each of the antenna elements so that the radiation from all of the antenna elements forms an equiphase front. This equiphase front is swept across different directions by continuously selecting the relative phase of each of the elements.

Prior known array antennas operating at much lower frequencies, such as a Yagi-Uda array antenna, mechanically rotate the antenna elements to steer the radiation pattern. It is physically impossible for such systems to satisfy the directional beam pattern switching requirement speed, on the order of micro-seconds, that many of today's communications applications demand. Accordingly, there is a need for an array antenna which can continuously form and sweep a beam pattern in different directions on the order of micro-seconds.

An array antenna currently being produced which can direct a beam pattern in micro-seconds uses phase shifters at the carrier frequency. This antenna is commonly designed to operate at carrier frequencies between 2 GHz and 30 GHz. The elements of the array antenna including the antenna elements, phase shifters, and radio frequency (RF) oscillators are usually fabricated on a semiconductor substrate. Each individual phase shifter is coupled to the output of an RF oscillator, which generates a sinusoidal steady-state RF carrier output signal, and to the input of an antenna element. These phase shifters shift the phase of the RF oscillator's output signal to a calculated value which is then transmitted by the coupled antenna element. By selectively determining the phase of the excitation of each element, as done by RADAR, a predicted radiation pattern can be formed. However, at higher operating frequencies phase shifters require higher switching currents and thus, adequate switching speeds could be a problem for many applications. Additionally, phase shifters are sensitive to the amount of RF input power and operating temperature which can result in phase shifting error. Furthermore, these systems suffer from the deficiency of having a power loss associated with each phase shifter. Typically, phase shifter losses vary from 2 dB, or 37% of the RF input power, at the commonly used RF carrier frequencies of 2 GHz to 30 GHz, and 7 dB, or 80% of the RF input power, at W-band (75–110 GHz) frequencies.

Another problem with the use of phase shifters at RF carrier frequencies is that for solid-state operation each phase shifter must be fabricated on the semiconductor substrate along with each antenna element to keep transmission power losses down to acceptable levels. For an array antenna to radiate power in a main beam pointing direction while having minimal side and backlobe levels, it is physically required that each antenna element be positioned within one wavelength of each other. Thus, as the operating frequency gets higher each antenna element has to be fabricated closer together. However, since phase shifters are 3-dimensional objects composed of ferrites and coils it is practically impossible to pack suitable phase shifters within the antenna elements at carrier frequencies higher than 30 GHz. Thus, the phase shifters limit how closely the antenna elements can be positioned to each other resulting in a practical maximum operable carrier frequency for the array antenna. Furthermore, it is expensive to fabricate phase shifters for each antenna element because there are usually dozens of antenna elements in an array antenna.

Another array antenna currently being produced which is designed to operate at RF carrier frequencies in the W-band utilizes low, noise Gunn sources. This technique involves the power combining of several transmitter diodes. However, due to isolation power losses between each diode, full power from each diode does not result from the combination. These low noise Gunn sources have long been unable to break the 100 mw barrier, which is needed across the RF spectrum for many applications.

SUMMARY OF THE INVENTION

According to the teachings of the present invention, an array antenna is provided which can form and sweep a radiation beam pattern from one direction to the next in micro-seconds, has a low power loss associated with each antenna element, eliminates cost associated with each antenna element, allows antenna elements to be spaced sufficiently close for operating at carrier frequencies up to 100 GHz and beyond, and is not susceptible to the amount of RF carrier input power or temperature variations.

The array antenna of the present invention forms a radiation beam pattern that can be steered without phase shifters operating at the carrier frequency. One embodiment of the array antenna generally includes an antenna structure and a remote circuit. The antenna structure is composed of individual antenna elements arranged in a uniform grid and each individually coupled to a local circuit. Each local circuit has a voltage controlled oscillator (VCO) for generating a sinusoidal steady-state carrier output signal to drive the antenna element, a coupler for taking a portion of the signal from the VCO, and a mixer for generating an intermediate frequency (IF) signal for use in the remote circuit.

The remote circuit generates and applies a control voltage error signal to the VCO for instructing the VCO to generate a carrier output signal having a certain frequency. By selectively controlling the frequency of the excitation of each element, different amounts of energy will be radiated at particular points in space forming a selected radiation pattern. Since the phase of a signal is dependent on its frequency, changing the frequency of a signal in relation to the other signals has the similar effect as shifting the relative phase as done by RADAR systems.

The remote circuit controls the frequency of the carrier output signal by generating a control voltage error signal. The error signal for each VCO is a function of the frequency of the IF signal compared with the frequency of a first given signal. The IF signal is generated in the mixer by mixing a second given signal with a subharmonic signal of the carrier output signal from the VCO. One of the given signals has a varying frequency which corresponds to a computed relative phase. The other given signal has a constant frequency. The VCO receives the error signal and changes the frequency of the carrier output signal causing the frequency difference between the IF signal and the first given signal to be smaller. This process is continually repeated in a phase locked loop (PLL) until the error signal is minimal, meaning that the frequency of the IF signal is equal to the frequency of the first given signal. At this point, the VCO is generating a carrier signal with a frequency corresponding to the computed relative phase. Thus, the phase of the excitation of the antenna element is controlled by offsetting the original carrier frequency. The combined resultant relative phase excitation of all the antenna elements generates a maximum field intensity in a predicted direction.

The remote circuit includes a selector for selecting the computed relative phase of the signal transmitted by each antenna element and a local oscillator for generating the constant frequency given (LO) signal. For each antenna element, there is a driver circuit located in the remote circuit. Each driver circuit has a variable frequency generator which is individually coupled to the selector. The variable frequency generator generates the variable frequency given signal which has a frequency corresponding to the computed relative phase as selected by the selector. The driver circuits further include a phase detector for generating the control voltage error signal which instructs the VCO to generate a new carrier output signal with a different frequency as a function of the difference in frequencies between the IF signal from the mixer and one of the given signals.

In a first embodiment of the invention, the mixer generates an IF signal as a function of a subharmonic frequency signal, which is generated from a portion of the VCO's output carrier signal, mixed with the LO signal. The IF output signal from the mixer and the signal from the variable frequency generator are fed into the phase detector which generates the control voltage error signal as a function of the frequency difference between these two signals.

In a second embodiment of the invention, the mixer generates an IF signal as a function of a subharmonic frequency signal, which is generated from a portion of the VCO's output carrier signal, mixed with the variable frequency generator signal. The IF output signal from the mixer and the LO signal are fed into the phase detector which generates the control voltage error signal as a function of the frequency difference between these two signals.

In both embodiments the phase detector, VCO, coupler, and mixer form the PLL for causing the VCO to generate an output carrier signal having a frequency corresponding to a computed relative phase.

BRIEF DESCRIPTION OF THE DRAWINGS

The invention will be further described in connection with the accompanying drawings, in which.

DETAILED DESCRIPTION OF THE INVENTION

Figure 1:
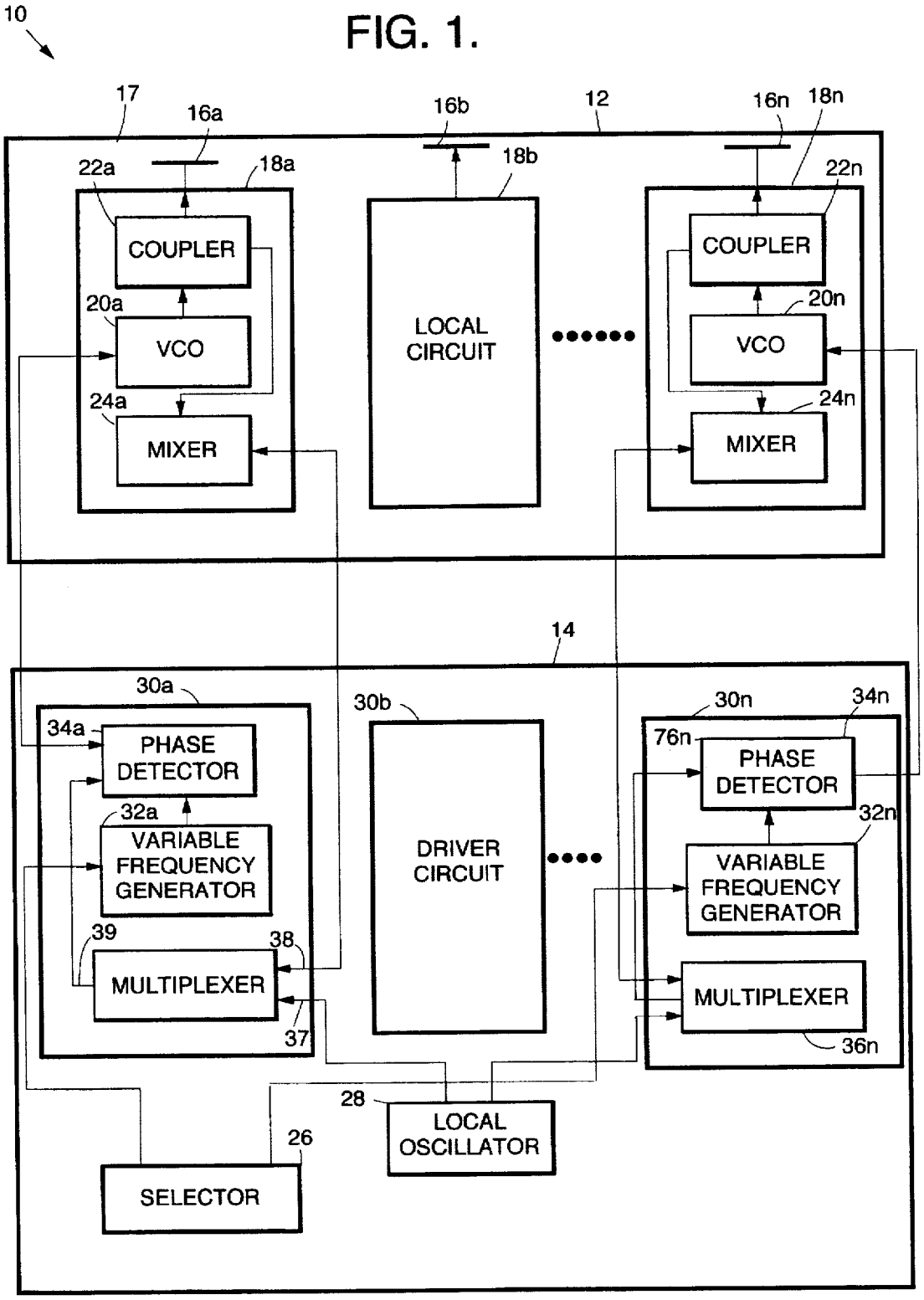
FIG. 1 generally shows a block diagram of a first embodiment of an active antenna array made in accordance with the teachings of this invention.

Referring to FIG. 1, an array antenna 10 is shown in accordance with the first embodiment of the invention. With reference specifically to FIG. 1, array antenna 10 includes an antenna structure 12 and a remote circuit 14.

Antenna structure 12 includes individual antenna elements 16(*a–n*) which are fabricated and aligned in a uniform grid on a semiconductor substrate 17. Each antenna element 16(*a–n*) is coupled individually to local circuits 18(*a–n*) which are fabricated adjacent to their respective antenna elements 16(*a–n*) on semiconductor substrate 17. Each local circuit 18(*a–n*) includes a voltage controlled oscillator (VCO) 20(*a–n*), a coupler 22(*a–n*), and a mixer 24(*a–n*). Each VCO 20(*a–n*) generates a radio frequency (RF) sinusoidal steady-state carrier output signal for driving an antenna element 16(*a–n*). Coupler 22(*a–n*) siphons a small portion of the signal generated by VCO 20(*a–n*) and feeds it into the first input of mixer 24(*a–n*). Coupler 22(*a–n*) feeds the larger signal from VCO 20(*a–n*) to drive antenna element 16(*a–n*). In a preferred embodiment, coupler 22(*a–n*) is a 20 dB coupler which only takes 1% of the power from the signal generated by VCO 20(*a–n*) for use in mixer 24(*a–n*). Mixer 24(*a–n*) initially converts the carrier signal generated by VCO 20(*a–n*) into a sinusoidal subharmonic signal that has a much lower frequency than the original carrier signal.

Remote circuit 14, physically located away from antenna structure 12, includes a selector 26, a local oscillator 28, and an individual driver circuit 30(*a–n*) for each antenna element 16(*a–n*). Each driver circuit 30(*a–n*) includes a variable frequency generator 32(*a–n*), a phase detector 34(*a–n*), and a multiplexer 36(*a–n*). Local oscillator 28 generates a constant frequency sinusoidal steady-state (LO) signal. The LO signal has a frequency on the order of the subharmonic signal. The LO signal is fed into a first port 37 of each multiplexer 36(*a–n*). First port 37 of multiplexer 36(*a–n*) passes the LO signal through a second port 38 of multiplexer 36(*a–n*). Second port 38 of multiplexer 36(*a–n*) is seen as a high pass filter for outgoing signals and passes the LO signal to the second input of mixer 24(*a–n*). Mixer 24(*a–n*) generates an intermediate frequency (IF) signal having a frequency that is the exact difference in frequency between the subharmonic signal and the LO signal. Mixer 24(*a–n*) sends the IF signal back to second port 38 of multiplexer 36(*a–n*) along the same transmission medium. Second port 38 of multiplexer 36(*a–n*) is seen as a low pass filter by incoming signals and passes the IF signal through a third port 39 of multiplexer 36(*a–n*) to phase detector 34(*a–n*).

Selector 26 is individually coupled to each variable frequency generator 32(*a–n*). Selector 26 selects the relative phase of the signal to be transmitted by each antenna element 16(*a–n*). Variable frequency generator 32(*a–n*) generates a signal with a frequency that corresponds to a signal having the relative phase as selected by selector 26. Furthermore, this signal has a frequency on the order of the IF signal from mixer 24(*a–n*).

The signal from variable frequency generator 32(*a–n*) and the IF signal from mixer 24(*a–n*) (via multiplexer 36(*a–n*))

are constantly fed into respective inputs of phase detector 34(*a–n*). Phase detector 34(*a–n*) generates a control voltage error signal as a function of the frequency difference between the two signals.

Figure 2:
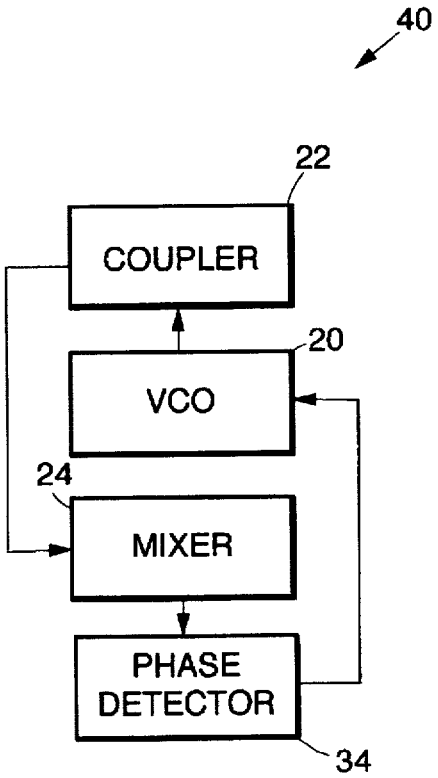
FIG. 2 shows a block diagram of a phase locked loop (PLL) made in accordance with the teachings of this invention.

FIG. 2 shows a phase locked loop (PLL) 40 consisting of VCO 20, coupler 22, mixer 24, and phase detector 34. PLL 40 is designed to set the frequency of the IF signal exactly the same as the frequency of variable frequency generator 32 signal. Phase detector 34 applies the control voltage error signal to VCO 20. In response to the error signal, VCO 20 changes the frequency of the signal it generates. As the new signal generated by VCO 20 enters into PLL 40, the IF signal has a frequency closer to the variable frequency generator 32 signal causing the error signal to change to a value representing a smaller frequency difference between these two signals. This process is repeated by PLL 40 until the error signal represents a minimum frequency difference. At this point, VCO 20 is generating a carrier signal with a frequency corresponding to the relative phase selected by selector 26. Thus, the phase of excitation of the antenna element is controlled by offsetting the original carrier frequency. The combined resultant relative phase excitation of all the antenna elements generates a maximum field intensity in a predicted direction.

Figure 3:
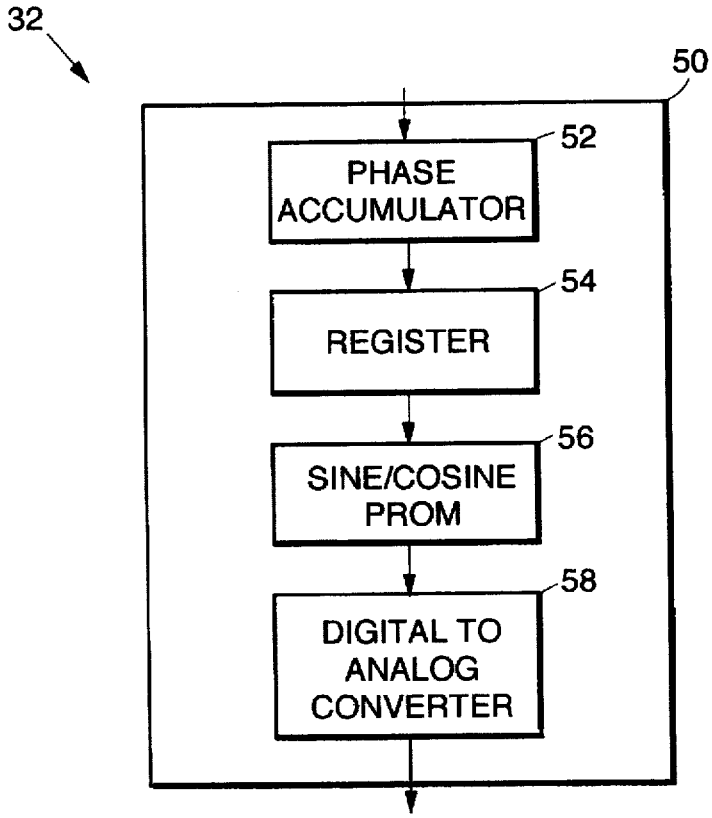
FIG. 3 shows a block diagram of a variable frequency generator for the first embodiment made in accordance with the teachings of this invention.

FIG. 3 further shows variable frequency generator 32. Each variable frequency generator 32 is a direct digital synthesizer (DDS) 50. DDS 50 includes a phase accumulator 52, a register 54, a sine/cosine PROM 56, and a digital to analog converter (DAC) 58.

Figure 4:
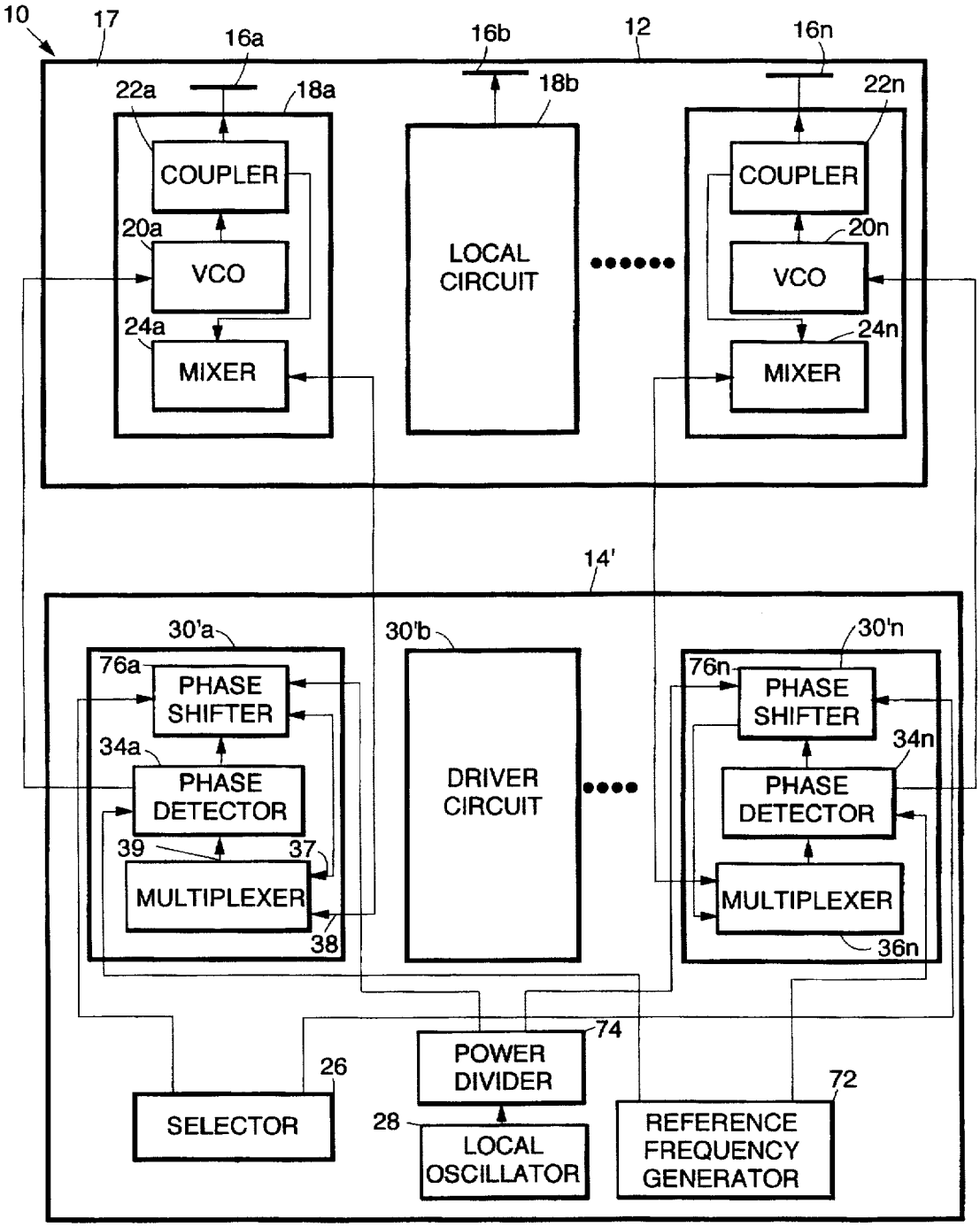
FIG. 4 generally shows a block diagram of a second embodiment of an active antenna array made in accordance with the teachings of this invention.

FIG. 4 generally shows a block diagram of a second embodiment of array antenna 10. Elements that are the same as in FIG. 1 are designated with the same reference numerals. The second embodiment of array antenna 10 also includes an antenna structure 12 and a remote circuit 14'. Antenna structure 12 includes the same elements as in FIG. 1.

Remote circuit 14' includes a selector 26, a local oscillator 28, a reference frequency generator 72, a power divider 74, and an individual driver circuit 30'(*a–n*) for each respective antenna element 16(*a–n*). Each driver circuit 30'(*a–n*) includes a phase shifter 76(*a–n*), a phase detector 34(*a–n*), and a multiplexer 36(*a–n*). Local oscillator 28 generates a constant frequency sinusoidal steady-state signal having a frequency that is much lower than the frequency of the carrier signal generated by each VCO 20(*a–n*). The output from local oscillator 28 is coupled to power divider 74. Power divider 74 transfers a portion of the output to each phase shifter 76(*a–n*) along separate transmission lines located in remote circuit 14'.

Selector 26 selects the relative phase of the signal to be transmitted by each antenna element 16(*a–n*). Phase shifter 76(*a–n*) generates a signal having the selected phase by shifting the phase of the signal provided from local oscillator 28. Since phase is a function of frequency, the phase shifted signal has a different frequency which corresponds to the selected relative phase. This signal from phase shifter 76(*a–n*) is fed into first port 37 of multiplexer 36(*a–n*) which passes it to second port 38 of multiplexer 36(*a–n*). Second port 38 of multiplexer 36(*a–n*) passes it through to an input of mixer 24(*a–n*).

Mixer 24(*a–n*) generates an IF signal having a frequency that is the exact difference in frequency between the signal from phase shifter 76(*a–n*) and the subharmonic frequency signal generated from the output of coupler 22(*a–n*). The IF signal is fed back to second port 38 of multiplexer 36(*a–n*) which passes it through to third port 39 of multiplexer 36(*a–n*). Third port 39 of multiplexer 36(*a–n*) passes it through to phase detector 34(*a–n*).

Phase detector 34(*a–n*) also receives a signal from reference frequency generator 72. Reference frequency generator 72 signal is a constant frequency sinusoidal steady-state signal having a frequency that is on the order of the IF signal generated by each mixer 24(*a–n*). Phase detector 34(*a–n*) generates a control voltage error signal as a function of the frequency difference between these two signals. The error signal is applied to VCO 20(*a–n*), which changes the carrier output frequency in response to the signal. Referring back to FIG. 2, the second embodiment of the invention also utilizes the same PLL 40. Here VCO 20 changes its output frequency until the error signal represents a minimum frequency difference between the IF signal from mixer 24 and the signal from reference frequency generator 72. At this point, VCO 20 is generating a carrier output signal with a frequency corresponding to the relative phase selected by selector 26.

Phase shifter 76 is operating with signals from local oscillator 28 in order to provide a signal for use in PLL 40. The signals provided by local oscillator 28 have a frequency that is much lower than the frequency of the carrier signal generated by each VCO 20. Phase shifter 76 does not have to be fabricated on antenna structure 12 because power losses associated with the transmission medium between phase shifter 76 and antenna element 16 are not important for this purpose. Phase shifter 76 only has to provide a signal that can be detected by mixer 24. If phase shifter 76 operated directly with a high power, high frequency carrier signal, such as a 100 GHz signal from VCO 20 for driving antenna element 16, then phase shifter 76 would have to be fabricated on antenna structure 12, because, in this case, an efficient application will try to generate as much output as the input it receives by reducing power losses. However, power losses associated alone with phase shifter 76 operating at 100 GHz would be 7 dB, or 80% of the input power. Obviously, the transmission medium has to be as small as possible by fabricating phase shifter 76 directly on semiconductor substrate 17 or else the remaining power will be lost. Thus, power losses associated with driving antenna element 16 can be greatly reduced by eliminating the use of phase shifter 76 operating directly with power signals at carrier frequencies.

It will be appreciated that both embodiments of the present invention allow for an array antenna that can form and steer a radiation pattern on the order of microseconds without having the power loss associated with using phase shifters at the carrier frequency. Eliminating phase shifters fabricated on the semiconductor substrate allows antenna elements to be positioned closer. This allows devices to be manufactured at lower prices and operate at higher frequencies while still producing the requisite power and radiation patterns needed for many applications.

While preferred forms of the invention have been shown in the drawings and described, since variations in the preferred forms will be apparent to those skilled in the art, the invention should not be construed as limited to the specific form shown and described, but instead is as set forth in the following claims.

What is claimed is:

1. An array antenna for forming and steering a radiation beam pattern comprising:

a.) an antenna structure having a plurality of individual antenna elements therein for generating the radiation beam pattern, each antenna element being coupled to an individual local circuit including:

a voltage controlled oscillator (VCO) generating a carrier output signal for driving said antenna element;

a coupler having an input connected to said VCO and a first output connected to said antenna element, for coupling said VCO to said antenna element;

a mixer connected to a second output of said coupler for generating an intermediate frequency (IF)signal; and b.) remote circuit means, physically located away from said antenna structure, including driver circuits respectively coupled to each said local circuit, for applying to said VCO an error signal, generated as a function of said IF signal from said mixer, causing said VCO to generate said carrier output signal, and said remote circuit means selectively controlling the frequency of the carrier output signals for each antenna element to thereby steer the radiation beam pattern.

2. The array antenna of claim 1, wherein said remote circuit means comprises:

a selector for selecting a computed relative phase of the signal to be transmitted by each individual said antenna element;

a local oscillator for generating a constant frequency signal; and wherein said driver circuits each include:

a variable frequency generator, coupled to the selector, for generating a variable frequency signal corresponding to said computed relative phase; and a phase detector having an output coupled to said VCO for controlling the frequency of said carrier output signal generated thereby and having first and second inputs, said first input being coupled to a given signal and said second input being coupled to an output of the mixer;

said phase detector providing said error signal to control the frequency of said VCO for its associated antenna element as a function of the frequency difference between the signals applied to the first and second inputs.

3. The array antenna of claim 2, wherein said mixer has inputs for receiving an output of said local oscillator and said second output of said coupler, for generating an intermediate frequency signal which is fed back to said second input of said phase detector.

4. The array antenna of claim 3, wherein said variable frequency signal from said variable frequency generator is fed to said first input of said phase detector.

5. The array antenna of claim 3, wherein said phase detector generates said error signal as a function of the frequency difference between said intermediate frequency signal from said mixer and said variable frequency signal from said variable frequency generator.

6. The array antenna of claim 2, wherein said mixer has inputs for receiving said variable frequency signal from said variable frequency generator and said second output of said coupler, for generating an intermediate frequency signal which is fed back to said second input of said phase detector.

7. The array antenna of claim 6, wherein said remote circuit means further comprises:

a reference frequency generator for generating a low frequency signal;

said reference frequency generator feeds said low frequency signal to said first input of said phase detector.

8. The array antenna of claim 6, wherein said phase detector generates said error signal as a function of the frequency difference between said intermediate frequency signal from said mixer and said low frequency signal from said reference frequency generator.

9. The array antenna of claim 3, wherein each said variable frequency generator included with each said driver circuit further comprises:

a phase accumulator for converting signals from said selector into an individual binary number signal indicative of said computed relative phase of the signal to be transmitted by each individual said antenna element;

a register coupled to said phase accumulator for storing said binary number signal;

a sine/cosine PROM coupled to said register for converting said binary number signal to a digital voltage signal; and a digital to analog converter coupled to said sine/cosine PROM for converting said digital voltage signal to a time varying analog signal.

10. The array antenna of claim 6, wherein each said variable frequency generator included with each said driver circuit comprises:

a phase shifter coupled to an output of said local oscillator;

said phase shifter shifting the phase of said output from said local oscillator thereby generating said variable frequency signal having a frequency corresponding to said computed relative phase.

11. The array antenna of claim 3, wherein each said driver circuit further comprises:

a multiplexer having a first port, a second port, and a third port, said first port being coupled to one of said output of said local oscillator for passing through said second port a local oscillator output signal to said input of said mixer and said second port being coupled to an output of said mixer for passing through said third port said intermediate frequency signal to said phase detector.

12. The array antenna of claim 6, wherein each said driver circuit further comprises:

a multiplexer having a first port, a second port, and a third port, said first port being coupled to said output of said phase shifter for passing through said second port said variable frequency signal to said input of said mixer and said second port being coupled to an output of said mixer for passing through said intermediate frequency signal to said phase detector.

13. The array antenna of claim 2, wherein said mixer, said VCO, said coupler, and said phase detector form a phase locked loop (PLL) circuit for causing in real-time said VCO to generate said carrier output signal having a frequency corresponding to said computed relative phase.

14. The array antenna of claim 1, wherein said antenna structure is fabricated on a semiconductor substrate.

15. An array antenna comprising:

a.) an antenna structure having a plurality of individual antenna elements therein, each antenna element coupled individually to an individual local circuit including:

a voltage controlled oscillator (VCO) generating a carrier output signal for driving said antenna element;

a coupler having an input connected to said VCO and a first output connected to said antenna element, for coupling said VCO to said antenna element;

a mixer connected to a second output of said coupler; and b.) remote circuit means, physically located away from said antenna structure, said remote circuit means including a selector for selecting a computed relative phase of the signal to be transmitted by each individual said antenna element and a local oscillator, said remote circuit means further including a driver circuit for each individual antenna element, said driver circuits each including:

a variable frequency generator, individually coupled to said selector, for generating a variable frequency signal corresponding to said computed relative phase; and a phase detector having an output coupled to said VCO for controlling the frequency of said carrier output signal generated thereby and having first and second inputs, said first input being coupled to said output of said variable frequency generator and said second input being coupled to an output of said mixer;

said mixer having inputs for receiving an output from said local oscillator and said second output of said coupler, for generating an intermediate frequency signal which is fed back to said second input of the phase detector, said phase detector generating an error signal as a function of the frequency difference between the intermediate frequency signal from said mixer and said variable frequency signal from said variable frequency generator, to thereby cause said VCO to generate said carrier output signal having a frequency corresponding to said computed relative phase.

16. The array antenna of claim 15, wherein each said variable frequency generator included with each said driver circuit comprises:

a phase accumulator for converting signals from said selector into an individual binary number signal indicative of said computed relative phase of the signal to be transmitted by each individual said antenna element;

a register coupled to said phase accumulator for storing said binary number signal;

a sine/cosine PROM coupled to said register for converting said binary number signal to a digital voltage signal; and a digital to analog converter (DAC) coupled to said sine/cosine PROM for converting said digital voltage signal to a time varying analog signal.

17. The array antenna of claim 15, wherein each said driver circuit further comprises:

a multiplexer having a first port, a second port, and a third port, said first port being coupled to one of said output of said local oscillator for passing through said second port said local oscillator output signal to said input of said mixer and said second port being coupled to an output of said mixer for passing through said third port said intermediate frequency signal to said phase detector.

18. The array antenna of claim 15, wherein said mixer comprises a subharmonic mixer for generating said intermediate frequency signal by generating a subharmonic frequency signal from said carrier output signal generated by said VCO and mixing said subharmonic frequency signal with said local oscillator signal.

19. The array antenna of claim 15, wherein said mixer, said VCO, said coupler, and said phase detector form a phase locked loop (PLL) circuit for causing in real-time said VCO to generate said carrier output signal having a frequency corresponding to said computed relative phase.

20. The array antenna of claim 15, wherein said antenna structure is fabricated on a semiconductor substrate.

21. An array antenna comprising:

a.) an antenna structure having a plurality of individual antenna elements therein, each antenna element individually coupled to an individual local circuit including:

a voltage controlled oscillator (VCO) generating a carrier output signal for driving said antenna element;

a coupler having an input connected to said VCO and a first output connected to said antenna element, for coupling said VCO to said antenna element;

a mixer connected to a second output of said coupler; and b.) remote circuit means, physically located away from said antenna structure, said remote circuit means including a selector for selecting a computed relative phase of the signal to be transmitted by each individual antenna element, a reference frequency generator for generating a low frequency signal, and a local oscillator, said remote circuit means further including a driver circuit for each individual antenna element, said driver circuits each including:

a phase shifter, having an input for receiving output from said local oscillator and individually coupled to said selector, for generating a variable frequency signal by shifting the phase of said output signal from said local oscillator to correspond to said computed relative phase selected by said selector; and a phase detector having an output coupled to said VCO for controlling the frequency of said carrier output signal generated thereby and having first and second inputs, said first input being coupled to said low frequency signal from said reference frequency generator and said second input being coupled to an output of the mixer;

said mixer having inputs for receiving said variable frequency signal from said phase shifter and said second output of said coupler for generating an intermediate frequency signal which is fed back to an input of said phase detector, said phase detector generating an error signal as a function of the frequency difference between the intermediate frequency signal from said mixer and said low frequency signal from said reference frequency generator, to thereby cause said VCO to generate said carrier output signal having a frequency corresponding to said computed relative phase.

22. The array antenna of claim 21, wherein said remote circuit means further comprises:

a power divider having an input for receiving output from said local oscillator and an output for each individual said phase shifter;

said power divider coupling a portion of said output signal from said local oscillator to each said phase shifter.

23. The array antenna array of claim 21, wherein each said driver circuit further comprises:

a multiplexer having a first port, a second port, and a third port, said first port being coupled to said output of said phase shifter for passing through said second port said variable frequency signal from said phase shifter to said input of said mixer and said second port being coupled to an output of said mixer for passing through said third port said intermediate frequency signal from said mixer to said phase detector.

24. The array antenna of claim 21, wherein said mixer comprises a subharmonic mixer for generating said intermediate frequency signal by mixing a subharmonic frequency of said carrier output signal generated by said VCO with said output from said phase shifter.

25. The array antenna of claim 21, wherein said mixer, said VCO, said coupler, and said phase detector form a phase locked loop (PLL) circuit for causing in real-time said VCO to generate said carrier output signal having a frequency corresponding to said computed relative phase.

26. The array antenna of claim 21, wherein said antenna structure is fabricated on a semiconductor substrate.

* * * * *